US007159998B2

(12) United States Patent
Moreland

(10) Patent No.: US 7,159,998 B2
(45) **Date of Patent: *Jan. 9, 2007**

(54) CHANNEL SYSTEM FOR LIGHT STRINGS

(76) Inventor: Karren Moreland, 1102 E. Country Gables, Phoenix, AZ (US) 85022

( * ) Notice: Subject to any disclaimer, the term of this patent is extended or adjusted under 35 U.S.C. 154(b) by 0 days.

This patent is subject to a terminal disclaimer.

(21) Appl. No.: 10/109,252

(22) Filed: Mar. 26, 2002

(65) Prior Publication Data

US 2003/0185008 A1 Oct. 2, 2003

(51) Int. Cl.
*F21V 21/00* (2006.01)

(52) U.S. Cl. ..... 362/249; 362/219; 362/250; 362/391; 362/396; 362/806

(58) Field of Classification Search ..... 362/250, 362/249, 238, 239; 248/237, 66, 317
See application file for complete search history.

(56) References Cited

U.S. PATENT DOCUMENTS

| | | | | |
|---|---|---|---|---|
| 2,692,375 | A | 10/1954 | Carson | |
| 3,569,691 | A | 3/1971 | Tracy | |
| 3,692,993 | A | 9/1972 | Robinson | |
| 3,836,936 | A | 9/1974 | Clement | |
| 4,128,863 | A | 12/1978 | Premetz | |
| 4,482,944 | A | 11/1984 | Roossine et al. | |
| 4,573,108 | A | 2/1986 | Castiglia et al. | |
| 5,067,061 | A | 11/1991 | Prickett | |
| 5,154,509 | A | 10/1992 | Wulfman et al. | |
| 5,469,344 | A | 11/1995 | Kotsakis | |
| 5,513,081 | A | 4/1996 | Byers | |
| 5,544,028 | A | 8/1996 | Carlin | |
| 6,364,508 | B1 * | 4/2002 | Moreland | 362/249 |

* cited by examiner

*Primary Examiner*—Sandra O'Shea
*Assistant Examiner*—Mark Tsidulko
(74) *Attorney, Agent, or Firm*—The Halvorson Law Firm

(57) ABSTRACT

The present invention is a kit or a channel system useful for the removable mounting (installation and removal) of ornamental light strings onto buildings such as houses, offices, stores, and the like. The system according to the present invention has at least one, preferably a series of, display channel pieces, or tracks, that are attached to a surface of a building, such as a house, store, office, or the like. The channel pieces are coupled together with coupling tabs. Slide mounts moveably fit within, and work with, channels within the channel pieces and are used to moveably secure ornamental light strings to the system when in use. Beveled edges located on distal ends of projections on the channel pieces allow for variable positioning of light strings using the channels system of the present invention. A slide mount guide is used to urge the mounted light string from a storage channel piece to the display channel pieces.

9 Claims, 13 Drawing Sheets

CHANNEL SYSTEM FOR LIGHT STRINGS

FIELD OF THE INVENTION

The present invention relates to the field of ornamental light string mounting devices. More specifically, the present invention relates to a channel track system for the moveable and removable mounting of ornamental light strings to the exterior and/or interior of buildings and the like.

BACKGROUND

It has become common practice to decorate homes, businesses, or other buildings during holiday seasons, such as Christmas, Halloween, Easter, and the like, by attaching strings of lights to achieve a decorative effect. The strings of lights are typically secured beneath overhanging eaves and around gables, and are also positioned to outline architectural features, whether interior or exterior, of the homes and businesses, such as windows, doorways, bars, and the like.

The strings of lights are usually secured in place by simple connectors such as staples, hooks, nails and the like. This method however, due to repetitive installation and removal of the staples, results in considerable marring of the wooden mounting surfaces and also can be dangerous because of potential damage to light string wires. Staples and other sharp objects are not a recommended method of installation but lacking other convenient methods of light string installation are used by many.

Longs strings of lights, as are typically used, are difficult to install and consequently a householder is often inclined to leave the lights in place once they are secured. Although this avoids yearly installation and removal, the strings of lights are exposed to weather for the full year resulting in their early deterioration and, furthermore, they add nothing to, and in fact detract from, the appearance of a house between holiday seasons. Further, the permanently attached light strings may conveniently express only a single holiday.

Light holders have heretofore been devised for attachment to buildings for attaching strings of lights in a regular manner and which afford the light strings some protection from the weather. These light holders required periodic use of a ladder while installing and removing the holiday light strings. Alternately, if the lights are left in place, they are continuously exposed to view. Consequently, unless the homeowner is content to accept the detraction from the aesthetic qualities of this home, the holders must be installed and removed each holiday season, such as Christmas, Halloween, and the like.

SUMMARY OF THE INVENTION

It is an object of the present invention to provide a channel system for the mounting of ornamental light strings.

It is another object of the present invention to provide a channel system for ornamental light strings that is inconspicuously mountable onto the exterior/interior of a building and that allows for adjustable placement and removal of the ornamental light strings.

It is a further object of the present invention to provide a storage system for ornamental light strings that functions in combination with a building mountable light string channel system.

It is yet another object of the present invention to provide a channel system that uses specifically designed slide mounts for mounting light strings, said slide mounts designed to travel along a slide mount channel formed in the channel pieces of a mountable channel system, there further being provided a slide mount slide handle useful for moving and placing the slide mounts of the present invention.

It is yet a further object of the present invention to provide a channel system that includes at least one type of corner piece that allows for angular tracking of the light string.

It is still yet another object of the present invention to provide a channel system that is coupled together by a removable coupling insert, thereby provide for contiguous and continuous movement and placement of the ornamental light string.

It is still yet a further object of the present invention to provide a channel system that includes track joiners to allow separate channels to be held together for ease of installation.

It is another object of the present invention to provide a channel system were the channels include a beveled edge that allows mounted light strings to hang straight regardless of mounting angle.

It is yet another object of the present invention to provide a channel system that includes a storage system that becomes a loader for the next time light strings are to be installed.

It is still yet another object of the present invention to provide a channel system that uses a loader to mount light strings to the channels and then, when the light strings are to be removed, the loader becomes the storage device for the light strings.

It is a further object of the present invention to provide a channel system were the channel pieces may be mitered together to fit unusual architectural angles and yet still allow continuous movement of slide mounts within the channel pieces.

It is a still further object of the present invention to provide a channel system that may be mounted to a substrate from the back wall or either side wall.

It is another object of the present invention to provide slide mount clips having a light string wire securing portion that secures the wire firmly so that it cannot slip.

Still another object of the present invention is to provide slide mount clips that are designed so they do not fall back into the channel.

Still another object of the present invention is to provide a system that, after initial installation of the channel system, greatly reduces the time for mounting lights and avoids the use of ladders, step stools, and the like.

Still yet another object of the present invention is to provide a system that makes it easy to change types of decorative lights depending on the season or occasion.

A further object of the present invention is to provide a continuous/contiguous channel system that allows continuous flowing installation of light stings along architectural features and outlines of buildings.

A still further object of the present invention is to provide an end cap to keep the light string from falling out of the end and to provide a hook to anchor the light string into final position.

The novel features that are considered characteristic of the invention are set forth with particularity in the appended claims. The invention itself, however, both as to its structure and its operation together with the additional objects and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS

Referring now to the figures, the present invention is a kit or a channel system 10 useful for the removable mounting (installation and removal) of ornamental light strings onto buildings such as houses, offices, businesses, stores, and the like.

The system 10 according to the present invention has at least one, preferably a series of display channel pieces 20, or tracks, that are quasi-permanently attached to a surface of a building, such as a house, store, office, or the like. The channel pieces 20 are coupled together with coupling tabs 50. The preferred embodiment includes a corner piece that is provided to allow for three dimensions of mounting of the ornamental light strings. In an alternate embodiment, the channel pieces 20 are mitered at individual ends to closely fit the outline of the building while still allowing moveable mounting of the light strings.

Figure 1:
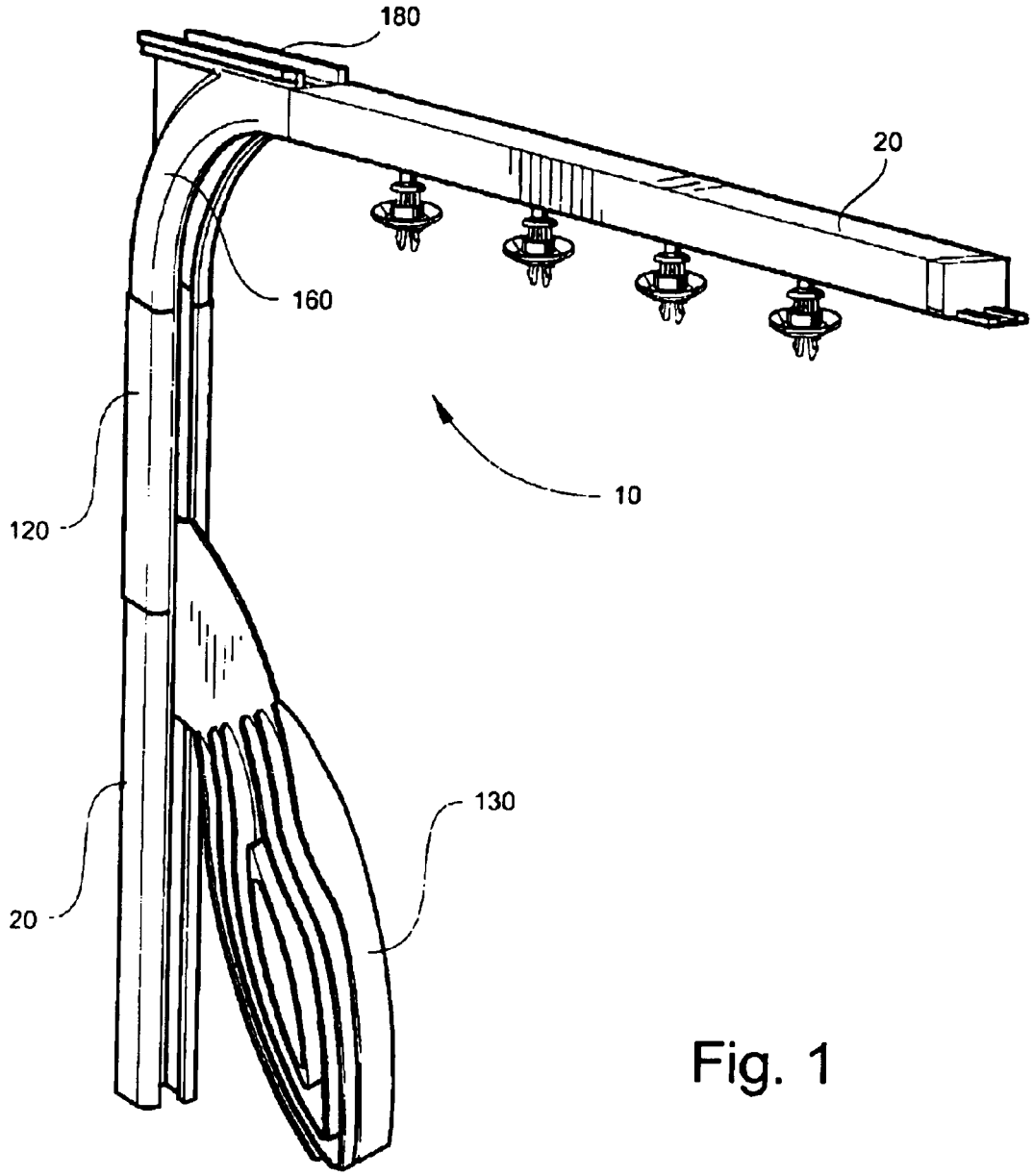
FIG. 1 illustrates an assembled embodiment of the present invention.
Figure 2:
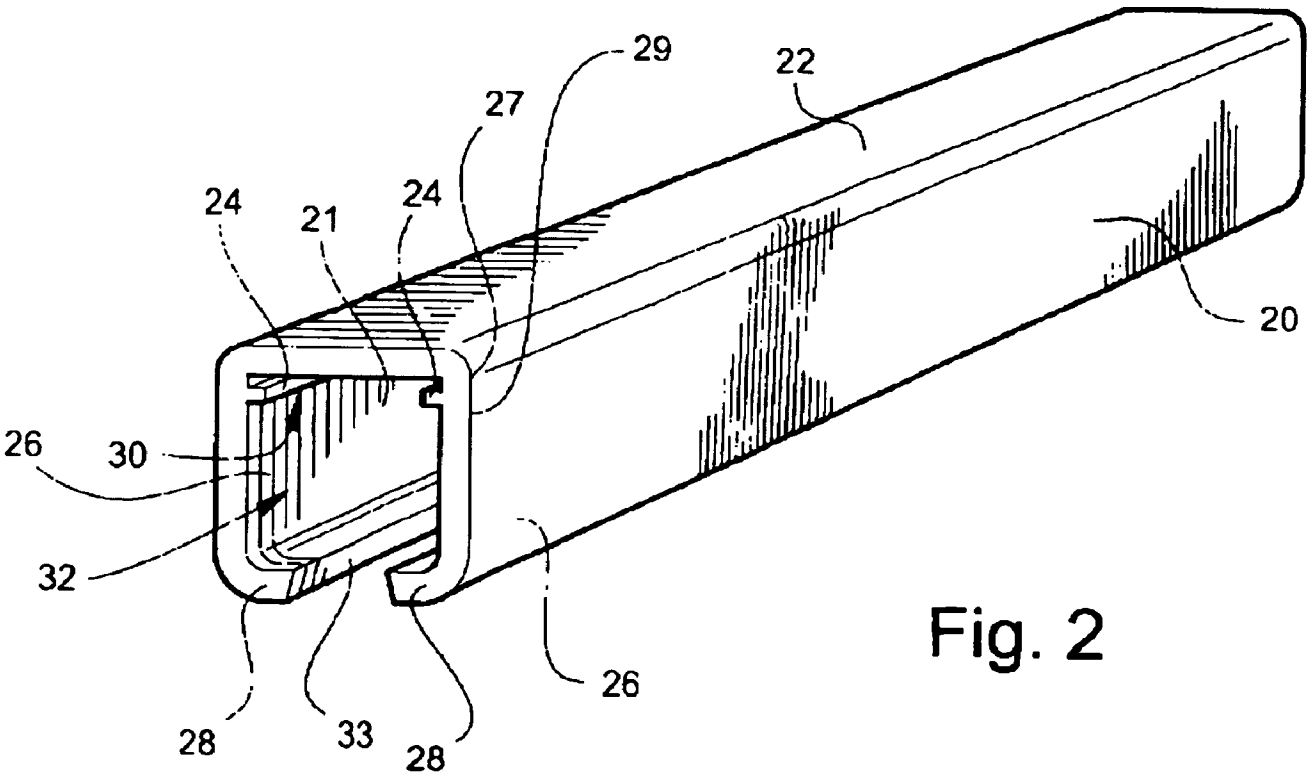
FIG. 2 is a perspective view of the channel pieces according to the present invention.

With reference to FIG. 2, the channel pieces 20 according to the present invention are long pieces, preferably made from plastic, that include a back wall 22, two sidewalls 26 attached to the back wall 22, two intermediate projections 24 inwardly disposed from the two side walls 26 and that define a channel, and two inwardly disposed ledges 28. The back wall 22 extends between back ends 27 of the sidewalls 26, respectively. The intermediate projections 24 extends between middle locations 29 of the sidewalls 26, respectively. The space defined by these five elements is a coupling channel 30 that extends the entire length of the channel piece 20. It is useful to note that the coupling channel 30 need only extend along a small portion of the channel piece 20, at both ends respectively. It is preferred, for economic and manufacturing reasons, that the coupling channel 30 extends the entire length of the channel piece 20. Furthermore, this allows the channel pieces 20 to be cut to any desired length when mounted onto the building.

The two inwardly disposed ledges 28 extend inwardly from front ends of the sidewalls 26, one on each sidewall, respectively. While the two ledges 28 are directed toward each other, they do not meet, thereby creating a slide mount channel 32 that extends the length of the channel piece 20. It is critical to the present invention that the slide mount channel 32 extends the entire length of the channel piece 20. Further, it is important for the present invention that distal ends 33 of the two ledges 28 have include a bevel for use with slide mounts 80, to be discussed in greater detail below.

On one embodiment, located periodically along the length of the channel piece 20 are at least one mounting aperture that extend through the back walls 22. This allows the head of mounting hardware, such as a screw, bolt, nail, or the like, to pass through the back wall 22 thereby snuggly securing the entire channel piece 20 to the surface of the building.

Alternately, the channel piece 20 may be made from a material that is pierceable by the mounting hardware thereby eliminating the need for the aperture that extends through the back wall 22.

Centrally located along the length of the back wall is a V-shaped notch 21. This notch 21 is designed to automatically center any mounting hardware, such as screws, as they are being applied. Thus, the mounting hardware is placed in the notch 21 that extends along the back wall 22, thereby piercing the back wall 22, and driving into the mounting surface of the building. Finally, in yet other embodiments, the channel system may be attached to the building by strong adhesives, clips or the like.

Figure 3:
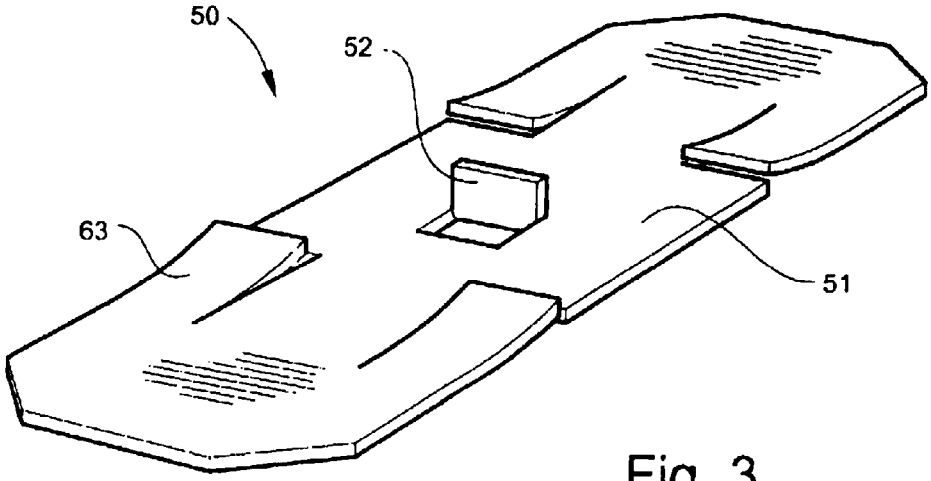
FIG. 3 is a coupling tab according to the present invention.

With reference to FIG. 3, the channel pieces 20 are coupled together by coupling tabs 50. The coupling tabs 50 include a body section 51. Centrally located on the body section 51 is a tab 52 that projects perpendicularly to the plane of the body 51. This tab 52 is used to limit the amount of the tab that may be inserted into any one channel piece 20. Further, located near each of the two ends of the body piece 51, are at least one, preferably two, barb sections 53. The barb sections 53, which project out of the plain of the body piece 51, are used to removably secure the coupling tabs 50 to the channel pieces 20. It can be seen that when inserted into the coupling channel 30, the barb sections 53 press against the back wall 22 of the channel pieces 20. While the coupling tabs 50 may be removed, the biasing of the barb section 53 against the back wall 22 of the channel pieces 20 prevents easy or inadvertent removal.

In use, the coupling tabs 50 are inserted into the coupling channels 30 located at each end of the channel piece 20. The coupling tabs 50 are forced into the coupling channel 30 until the barb sections 53 engages the back wall 22 of the coupling channel 30. This, then, secures the coupling tabs 50 into place. This process is repeated with additional channel piece 20 for the remaining end of the coupling tab 50, thereby coupling two channel pieces 20 together.

Figure 4:
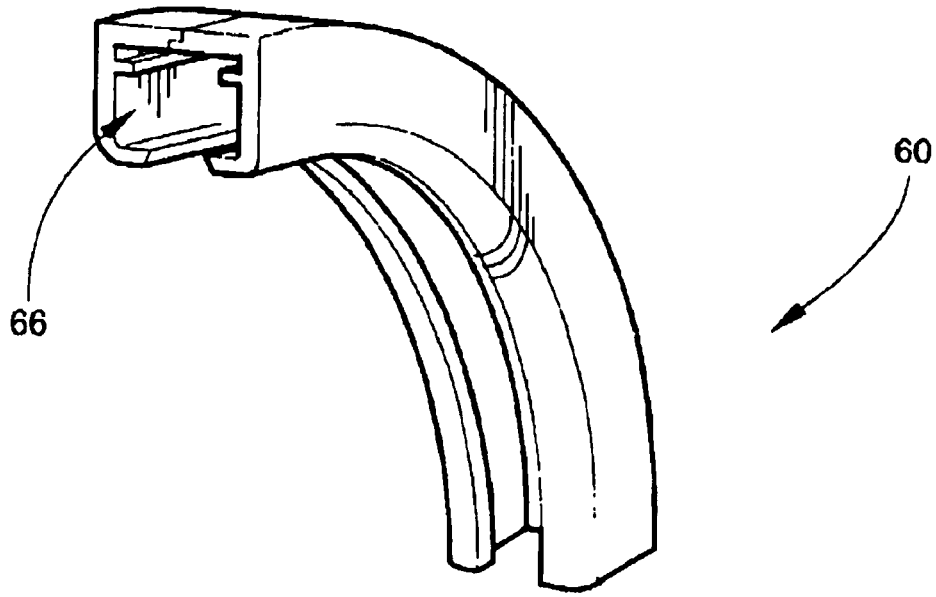
FIG. 4 is a corner piece according to the present invention.

With reference to FIG. 4, when a corner is encountered on the building being decorated, the substantially straight channel pieces 20 may mitered to the appropriate angles or they may be coupled together with a corner piece 60 that would be provided with the system. A corner piece 60 is used for coupling two channel pieces 20 within the same or different horizontal plane. This situation occurs when a corner of the building or eave is encountered. The corner piece 60 has the same basic structure as the substantially straight channel piece 20, but with an angled or curved bend, preferably substantially ninety-degrees, directed toward one of the sides. Alternatively, the corner piece 60 may be made from a flexible material that allow bending of the corner piece 60 thereby enabling odd angles and/or out of plane coupling.

Figures 5, 6:
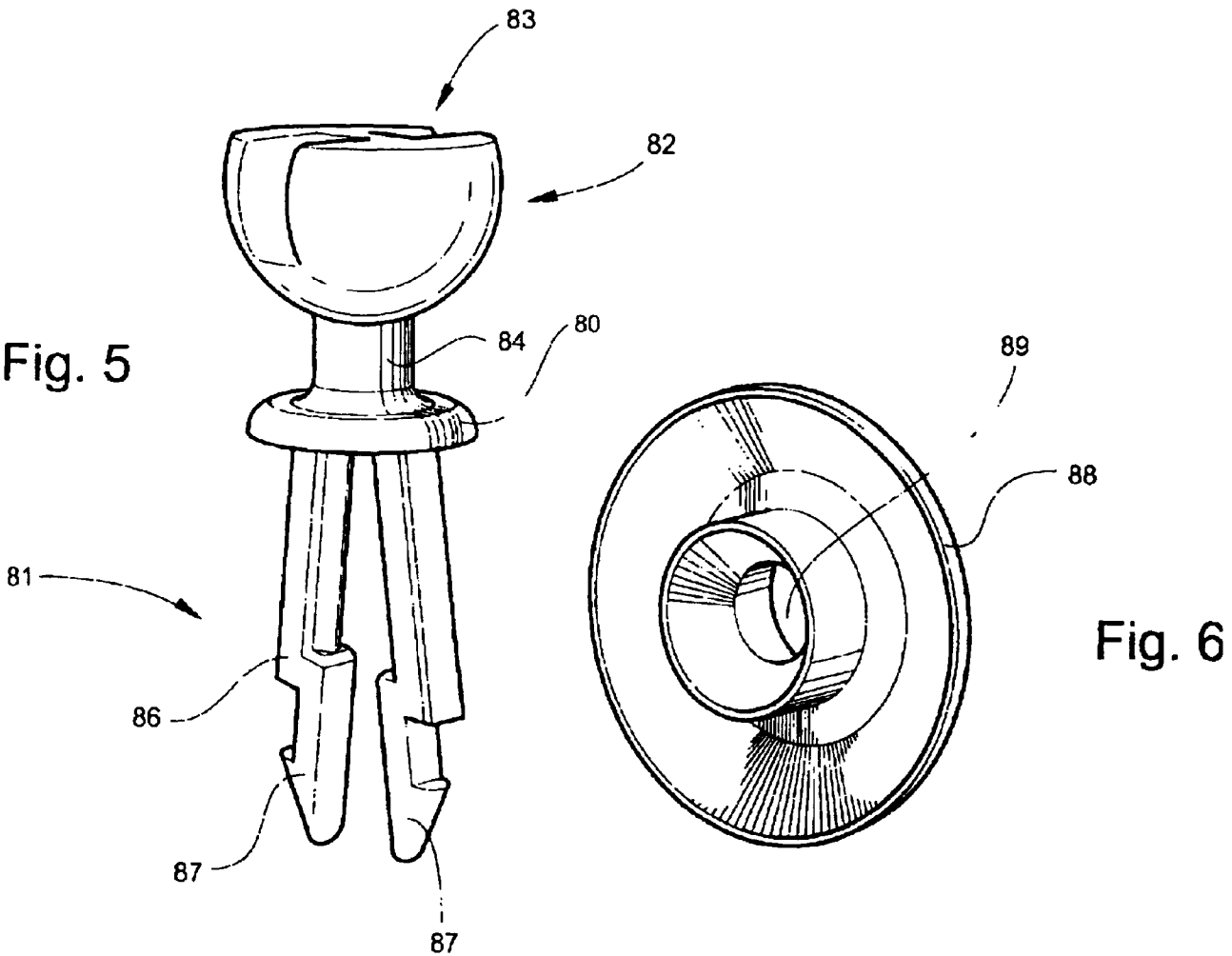
FIG. 5 is a slidable section of the slide mount according to the present invention.
FIG. 6 is a cap of the slide mount according to the present invention.
Figure 7:
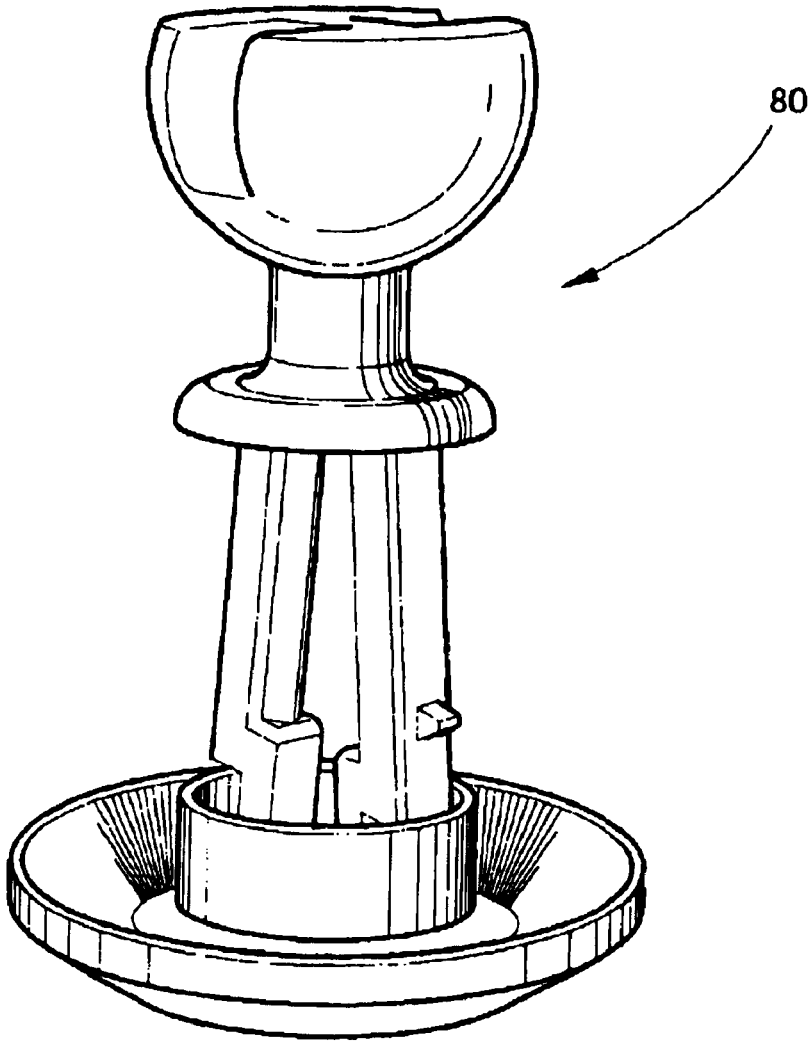
FIG. 7 illustrates assembly of the slidable section and cap of the slide mounts to complete the slide mount according to the present invention.

With reference to FIGS. 5–7, there are a plurality of slideable slide mounts 80 are included to moveably couple light strings to the channel system 10. Each slide mount 80 has a slideable body 82 with an attached light string securing portion 81. The slidable body 82 is preferably semi-spherical in shape with two opposed, cut-out sections 83. There is a downward portion 84 that projects from the apex of the semi-spherical shape and attaches to the light string securing portion 81, which includes a shoulder element 85 that prevents unwanted inward movement of the slide mounts 80 in place, relative to the interior of the channel pieces 20. In one embodiment the string securing portion 81 is two depending legs 86 that slightly digress from each other. At distal ends of the legs are cap securing barbs 87. Thus, an electrical wire of a light string may be inserted between the legs and the cap securing barbs 87 forced into an aperture 89 located in a cap 88. By forcing the cap securing barbs into the cap 88, the legs, which are effectively flexible, are squeezed together, thereby securing the light string to the slide mount 80. Further, since the legs 86 are flexible, they may be squeezed together to allow the cap 88 to be removed from the slide mount 80, thereby allowing the slide mount 80 to be removed from the light string.

It should be noted that the semi-spherical shape of the slidable body 82, working with the downward projection 84 and the bevels 33 on the two ledges 28 on the channel pieces 20, allow the slide mounts 80 to be pivoted into anyone of numerous positions. This feature allows the channel pieces 20 to be mounted on angled substrates while allowing the light strings to be aligned in a non-angled (or alternate angled) fashion.

Additionally, the downward portion 84 that projects from the apex of the slidable body 82 of the slide mounts 80 may include an articulated joint (not shown). The articulated joint is used to provide additional flexibility in the positioning of mounted light strings.

Figure 8:
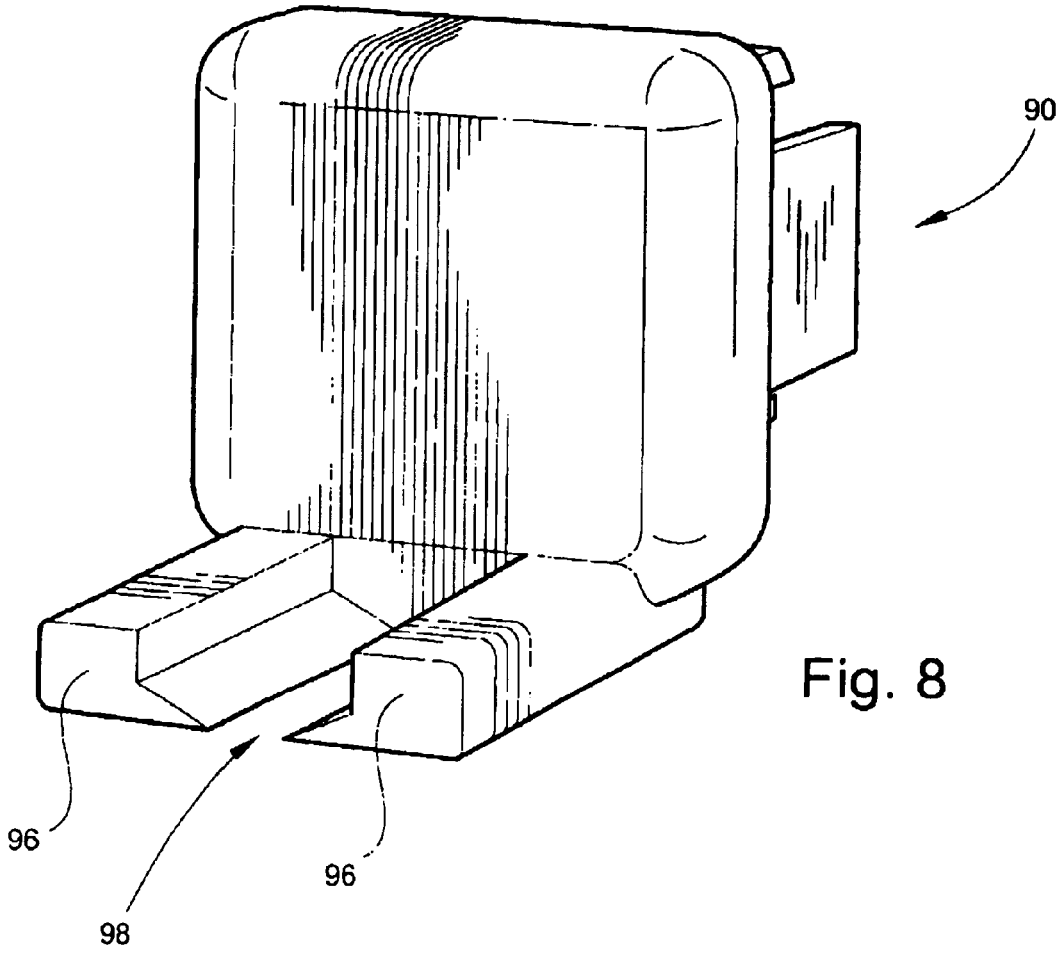
FIG. 8 is a front perspective view of the end cap according to the present invention.
Figure 9:
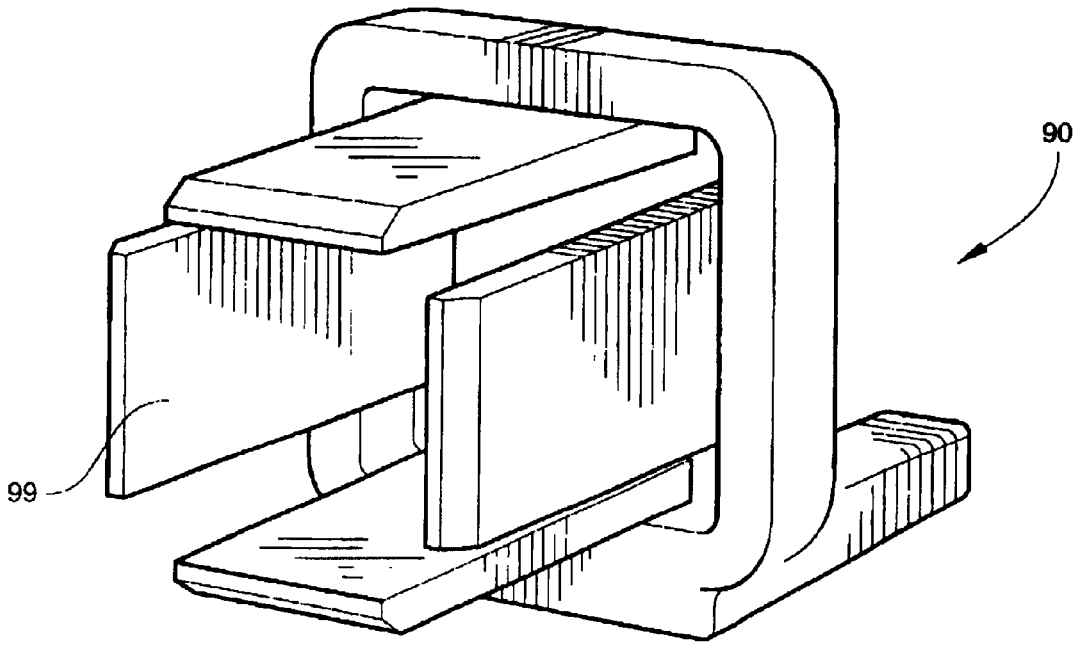
FIG. 9 is a rear perspective view of the end cap according to the present invention.
Figure 10:
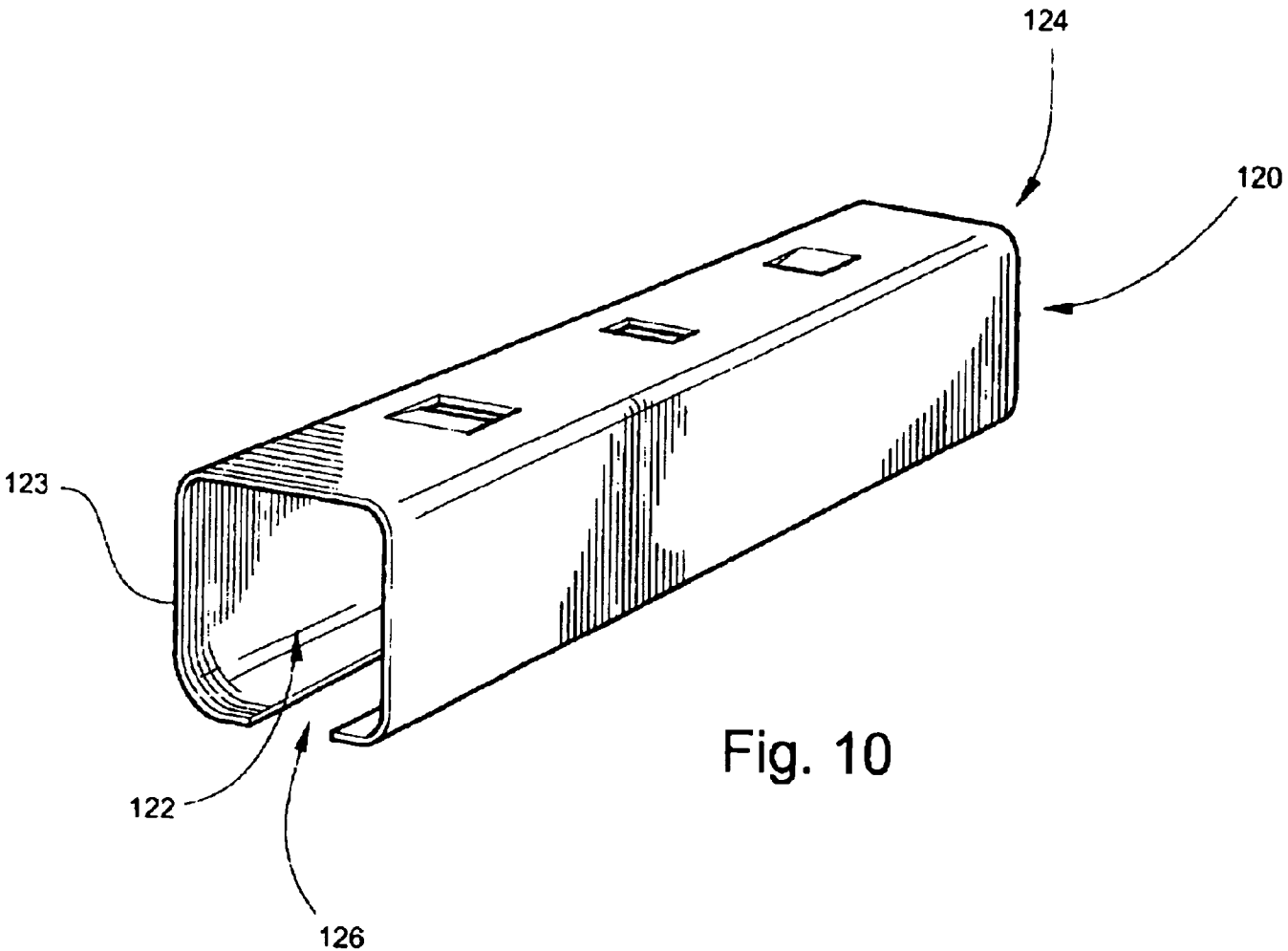
FIG. 10 is a perspective view of a coupling channel piece according to the present invention.
Figure 11:
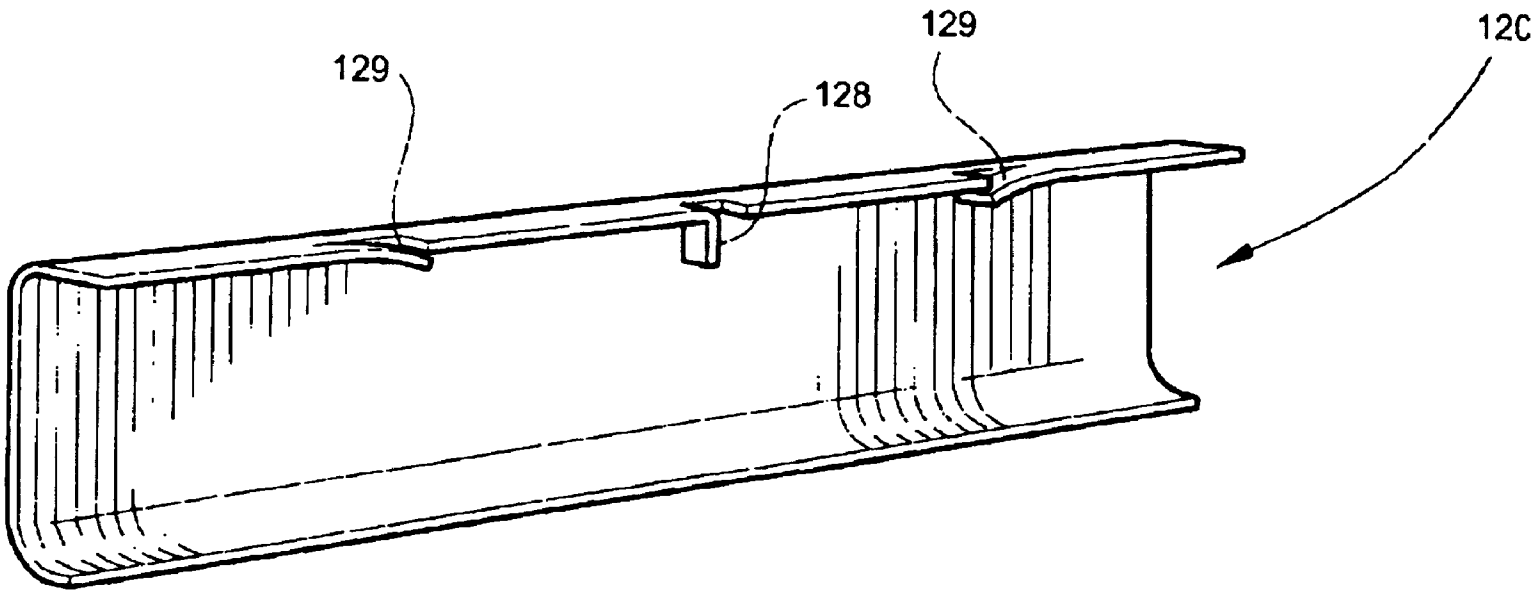
FIG. 11 is a sectional view of the coupling channel pieces according to the present invention.
Figure 12:
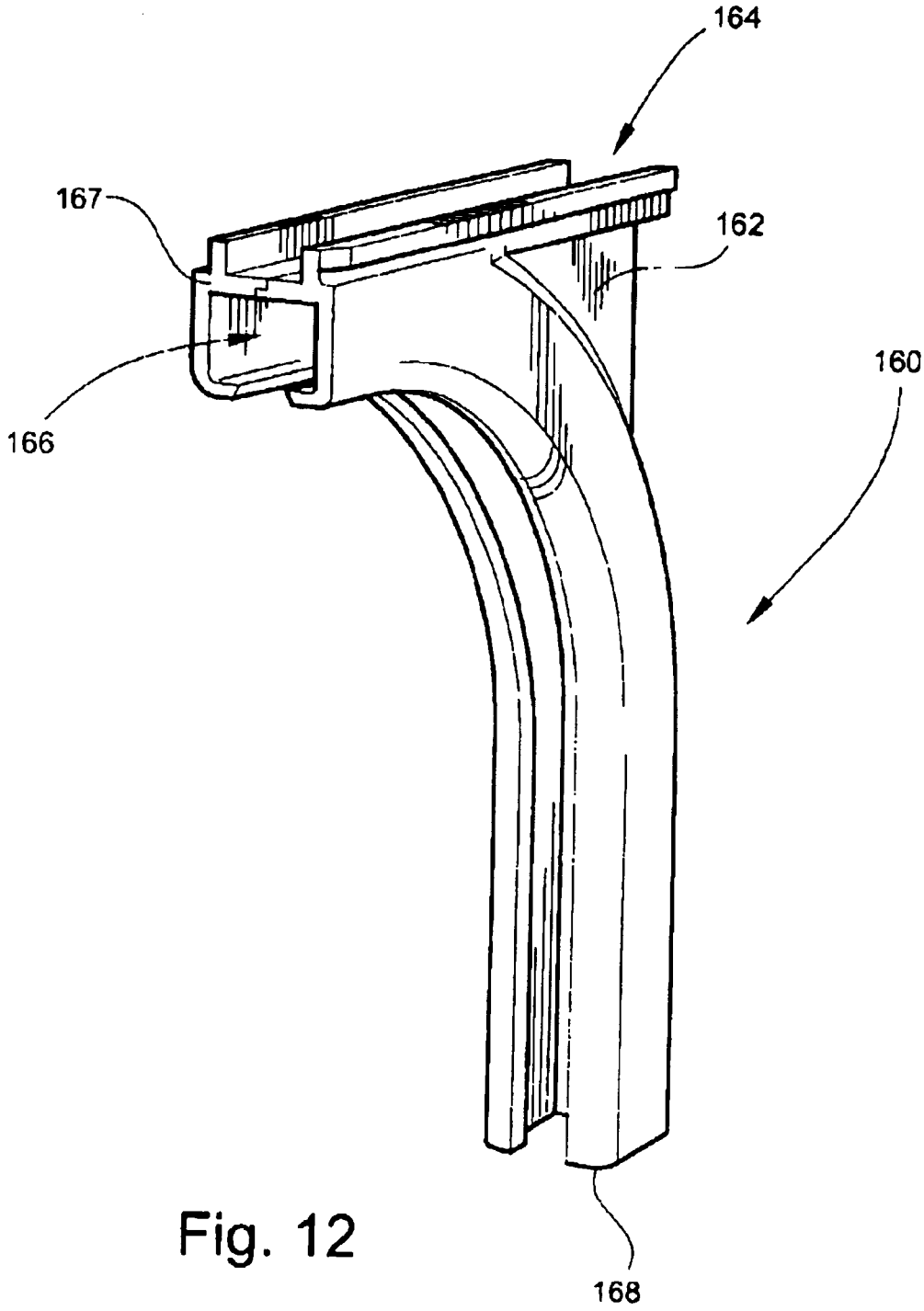
FIG. 12 is a loading corner for the corner piece according to the present invention.
Figure 13:
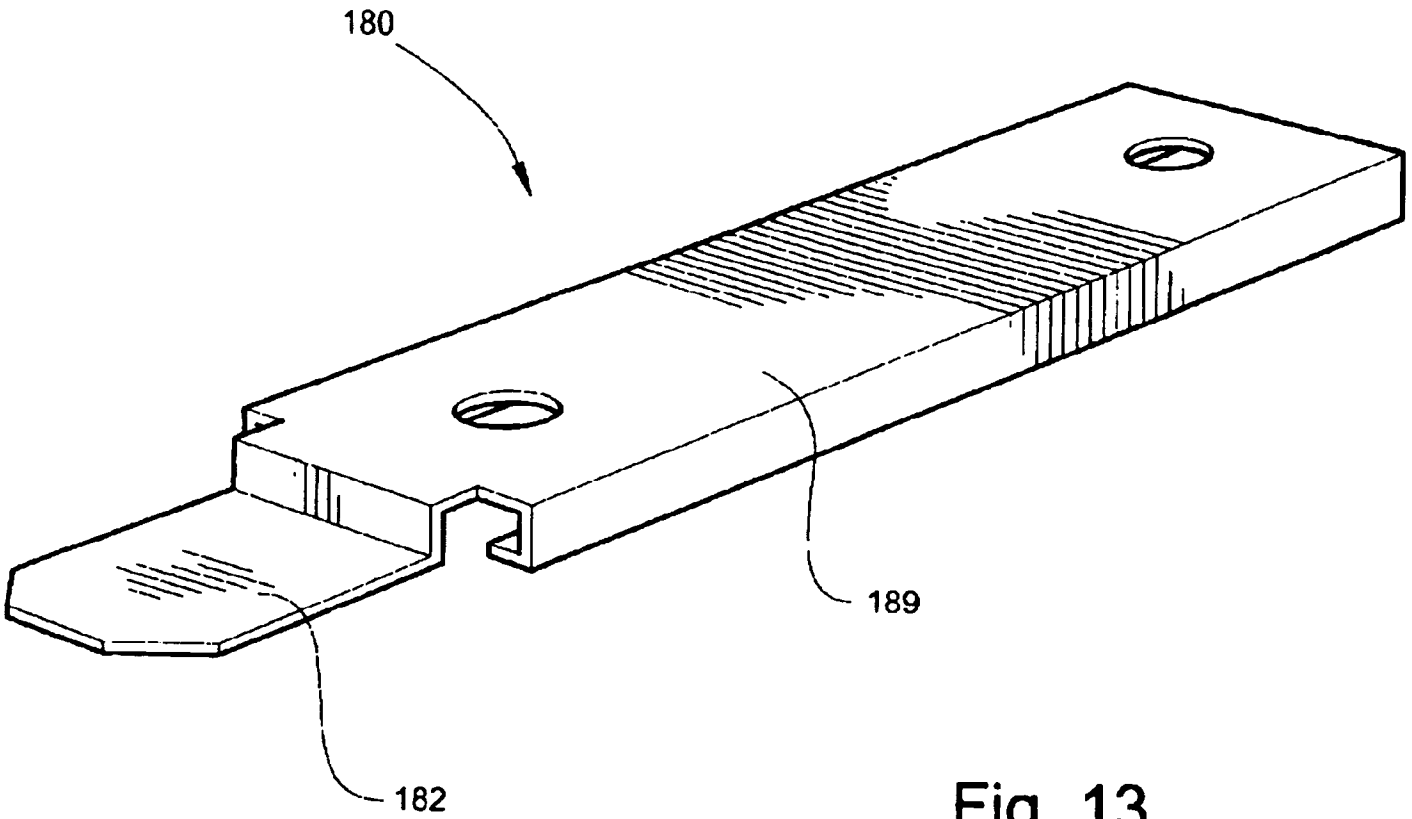
FIG. 13 is a perspective of the loading channel mount according to the present invention.

With reference to FIGS. 8 and 9, there is an end cap 90 is provided for sealing uncoupled ends of each channel piece 20. The end cap 90 has four projecting legs 94. Legs 94 are sized to fit within the coupling channel 30 and slide mount channel 32. Thus, when in place, the end piece 90 provides a finished look to the channel system 10 and prevents the ornamental light strings from accidentally being moved past an unused end of the channel piece 20 and falling out of the system 10, moving out of place, or moving backwards.

Located on a side of the end cap 90 opposite where the legs 94 are located are two projecting arms 96. The projecting arms 96 define a channel 98, which hold an end of the electrical light cord in place.

When in use, the plurality of channel pieces 20 and corner pieces 60 are mounted to an exterior (or interior) surface of a building to form a contiguous channel system 10. More than one separate channel system 10 may be mounted on any single building. Each contiguous channel system 10 has two uncoupled ends. One end may have a second corner piece 60 attached thereto, while the remaining uncoupled end should have an end cap 90 mounted therein. Once the contiguous channel system 10 is mounted to the building it is ready for light strings to be mounted therein.

With reference to FIGS. 10–13, in the preferred embodiment, a channel piece 20 that works with a loading corner 160. In order to move the light strings from the storage channel through the loading corner 160 to the display channels, there is a separate coupling channel piece 120. The loading corner 160 includes a loading channel 166 that extends from a first open end 167 to a second open end 168. Likewise, the coupling channel piece 120 has a coupling channel 122 that extends from a first open end 123 to a second open end 124. Extending along the length of the coupling channel 122 is a slide mount channel, 126 that allows the slide mounts 80 to be moved past the coupling channel piece 120. Further, the coupling channel piece 120 includes a centrally located, inwardly projecting, tang 128 that limits the length of loading corner 160 and storage channel that may be inserted into the coupling channel piece 120. Located on either side of the tang 128 are two inwardly projection barbs 129 that allow the loading corner 160 and storage channel to be securely, but removably inserted into the coupling channel piece 120 by providing a slight pressure bias to movement.

A plurality of slide mounts 80 are fitted within the slide mount channel 32 and the light strings are attached to the slide mounts 80. The storage channel 120 is then coupled to the loading corner 160 using the coupling channel 120, which fits over ends of the both of the storage channel and the loading corner 160. The light string, mounted on the plurality of slide mounts 80, may then be moved from the storage channel piece 120 to the mounted channel systems 10 and arranged for decoration.

For stability, the loading corner 160 has a support 162 that can be coupled to a loading channel mount 180. The loading channel mount 180 is mounted to the substrate and has a projecting tab 182. The loading corner 160 has a coupling channel 164 that fits around the body section 184 of the loading channel mount 180. This leaves the projecting tab free to be inserted into the first channel piece 20 used in the decorating system.

Figure 14:
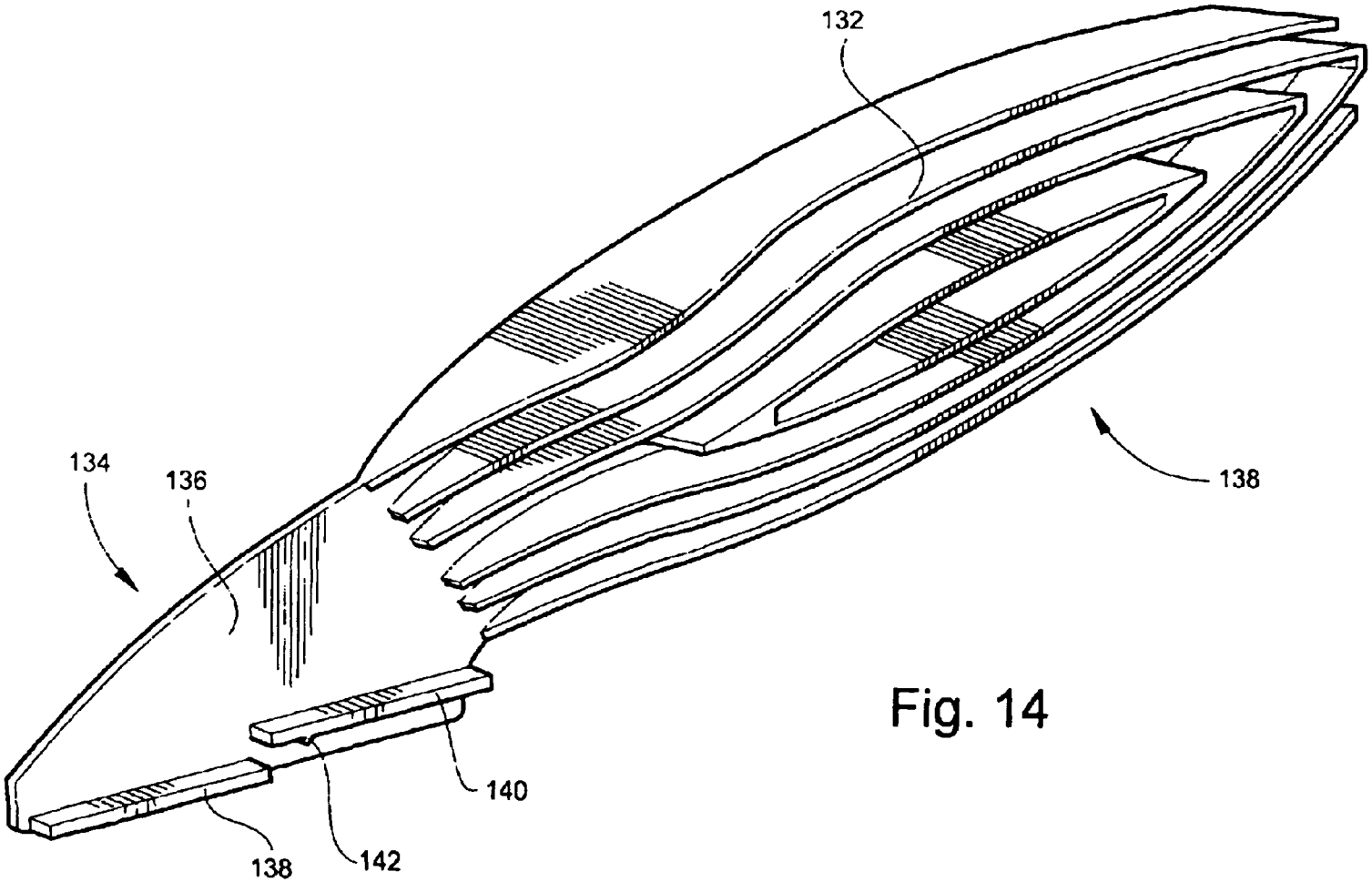
FIG. 14 is a perspective view of the light pusher according to the present invention.

It is preferred that the light string mounted on the plurality of slide mounts 80 be moved from the storage channel 120 to the mounted channel system 10 using a hand-held slide mount guide 130, FIG. 14. The guide 130 has a handle 132 that is preferably conformed to a human grip. Located at a distal end 134 of the handle 132 of the guide 130 is a guide piece 136. The guide piece 136 is placed underneath (or adjacent to) the light string mounted on the plurality of slide mounts 80 and used to urge or force the mounted light string from the storage channel piece 120 to the mounted channel system 10. In its most preferred form, the guide piece 136 has a width that fits within the space between the two ledges 28 of the channel piece 20. Thus, the pressure exerted by the guide piece 136 may be applied directly to the crossbar 82 of the plurality of slide mounts 80. In the preferred embodiment, the guide piece 136 includes a first slide ledge 138 that fits within the slide mount channels 32 of the channel pieces 20. There is a second slide ledge 140 that fits on the outside of the slide mount channels 32 of the channel pieces 20. There is a placement set projection 142 located on the underside of the second slide ledge 140 that is used to maintain the position of the slide mount guide 130, when it is not being moved. This is accomplished by merely releasing the slide mount guide 130 and gravity acting upon the handle 132 forces the set projection 142 against the channel piece 20 thereby acting as a cantilever. By merely pulling the handle 132 a slight distance from the channel piece 20 the position of the slide mount guide 130 may be release or changed.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A kit for mounting ornamental light strings comprising a. at least one channel piece having a back wall extending between two side walls and two intermediate projections that extends from the two side walls thereby creating a coupling channel therebetween, the channel piece further having two inwardly disposed ledges that extend inwardly from front ends of the side walls, respectively, thereby creating a slide mount channel that extends the length of the channel piece;

b. at least one coupling tab that is sized to fit within the coupling channel and thereby couple two channel pieces together;

c. a storage channel having a back wall extending between two side walls and two intermediate projections that extends from the two side walls thereby creating a coupling channel therebetween, the channel piece further having two inwardly disposed ledges that extend inwardly from front ends of the side walls, respectively, thereby creating a slide mount channel that extends the length of the channel piece;

d. at least one slide mount having a first end that is adapted to work with the slide mount channels in the channel pieces for movably transferring a light string between channel pieces and mounting the light string to the channel pieces; and e. a slide mount guide for moving slide mounts from the storage channel piece to the at least one display channel piece.

2. The kit as in claim 1 further including at least one end cap having an end piece with four legs, said legs sized to fit within the coupling channel and the slide mount channel.

3. The kit as in claim 2 wherein the first end of the slide mount further includes a semispherical slidable body with two divergent legs attached to the slidable body, said slideable body sized to movably fit within the slide mount channel of the channel pieces.

4. The kit as in claim 2 wherein the slide mount guide further has located at a distal end of a handle portion a guide piece, said guide piece having a width that fits within and extends between the space between the two ledges of the channel piece.

5. The kit as in claim 3 wherein the slide mount guide further has located at a distal end of a handle portion a guide piece, said guide piece having a width that fits within and extends between the space between the two ledges of the channel piece.

6. The kit as in claim 1 wherein the first end of the slide mount further includes a semispherical slidable body with two divergent legs attached to the slidable body, said slideable body sized to movably fit within the slide mount channel of the channel pieces.

7. The kit as in claim 6 wherein the slide mount guide further has located at a distal end of a handle portion a guide piece, said guide piece having a width that fits within and extends between the space between the two ledges of the channel piece.

8. The kit as in claim 1 wherein the slide mount guide further has located at a distal end of a handle portion a guide piece, said guide piece having a width that fits with the space between the two ledges of the channel piece.

9. A kit for mounting ornamental light strings comprising a. at least one display channel piece having a back wall extending between two side walls and two intermediate projections that extends from the two side walls thereby creating a coupling channel therebetween, the channel piece further having two inwardly disposed ledges that extend inwardly from front ends of the side walls, respectively, thereby creating a slide mount channel that extends the length of the channel piece;

b. at least one coupling tab that is sized to fit within the coupling channel and thereby couple two channel pieces together;

c. a storage channel having a back wall extending between two side walls and two intermediate projections that extends from the two side walls thereby creating a coupling channel therebetween, the channel piece further having two inwardly disposed ledges that extend inwardly from front ends of the side walls, respectively, thereby creating a slide mount channel that extends the length of the channel piece;

d. at least one end cap having an end piece with four legs sized to fit within the coupling channel and the slide mount channel;

e. at least one slide mount having a first end that is adapted to work with the slide mount channels in the channel pieces for movably transferring a light string between channel pieces and mounting the light string to the channel pieces, the first end of the slide mount further includes a semispherical body with an attached light string securing portion, said semispherical body sized to movably fit within the slide mount channel of the channel pieces; and f. a slide mount guide for moving slide mounts from the storage channel piece to the at least one channel piece, the slide mount guide further has located at a distal end of a handle portion a guide piece, said guide piece having a width that fits with the space between the two ledges of the channel piece.

* * * * *